US009295340B2

(12) United States Patent
Scarlett et al.

(10) Patent No.: US 9,295,340 B2
(45) Date of Patent: Mar. 29, 2016

(54) CUSHIONING SYSTEM

(71) Applicant: Roger Thomas Mascull and Elizabeth Jocelyn Mascull as trustees of the RT and EJ Mascull Family Trust, Ashburton (NZ)

(72) Inventors: Rouand James Mortimer Scarlett, Auckland (NZ); Roydon Mark Scarlett, Auckland (NZ)

(73) Assignee: Roger Thomas Mascull and Elizabeth Jocelyn Mascull as Trustees of the RT and EJ Mascull Family Trust, Allenton, Ashburton (NZ)

( * ) Notice: Subject to any disclaimer, the term of this patent is extended or adjusted under 35 U.S.C. 154(b) by 0 days.

(21) Appl. No.: 14/426,031

(22) PCT Filed: Sep. 4, 2013

(86) PCT No.: PCT/NZ2013/000158

§ 371 (c)(1),
(2) Date: Mar. 4, 2015

(87) PCT Pub. No.: WO2014/038961

PCT Pub. Date: Mar. 13, 2014

(65) Prior Publication Data

US 2015/0189996 A1 Jul. 9, 2015

(30) Foreign Application Priority Data

Sep. 4, 2012 (NZ) ..... 602234

(51) Int. Cl.
*A47C 27/00* (2006.01)
*A47C 31/12* (2006.01)
(Continued)

(52) U.S. Cl.
CPC ..... *A47C 31/12* (2013.01); *A47C 7/021* (2013.01); *A47C 7/14* (2013.01); *A47C 27/081* (2013.01); *A47C 27/085* (2013.01); *A47C 27/14* (2013.01); *A61G 5/1043* (2013.01); *A61G 2005/1045* (2013.01); *A61G 2005/1048* (2013.01)

(58) Field of Classification Search
CPC .... A47C 27/001; A47C 27/14; A47C 27/081; A47C 27/085; A47C 7/14; A47C 7/021; A47C 31/12; A61G 5/1043; A61G 2005/1045; A61G 2005/1048
USPC ..... 5/722, 723, 653, 654, 657
See application file for complete search history.

(56) References Cited

U.S. PATENT DOCUMENTS 1,528,066 A * 3/1925 McEntire ..... 5/722
2,548,547 A * 4/1951 Melrose ..... 5/723
(Continued)

FOREIGN PATENT DOCUMENTS

EP 0412563 A1 * 2/1991
WO WO 92/14387 9/1992
(Continued)

OTHER PUBLICATIONS

International Search Report for International Application No. PCT/NZ2013/000158 mailed Nov. 28, 2013 (3 pages).

*Primary Examiner* — Michael Trettel
(74) *Attorney, Agent, or Firm* — Merchant & Gould P.C.

(57) ABSTRACT

The invention provides a cushioning system having an adjustable contoured surface, the system comprising a panel, a plurality of cells; and attachment means for detachably attaching one or more cells to the panel at any location on the panel and in any orientation relative to the panel to provide the contoured surface. The contoured surface is determined by the number, shape, size, position, and orientation of cells on the panel. Optionally, the cells can be attached to each other and stackable upon one another.

22 Claims, 8 Drawing Sheets

(51) Int. Cl.

| | |
|---|---|
| ***A47C 27/08*** | (2006.01) |
| ***A47C 7/02*** | (2006.01) |
| ***A47C 7/14*** | (2006.01) |
| ***A47C 27/14*** | (2006.01) |
| *A61G 5/10* | (2006.01) |

(56) References Cited

U.S. PATENT DOCUMENTS

| | | | | |
|---|---|---|---|---|
| 4,843,666 | A * | 7/1989 | Elesh et al. | 5/723 |
| 5,592,706 | A * | 1/1997 | Pearce | 5/654 |
| 5,634,225 | A | 6/1997 | Miller, Sr. et al. | |
| 6,321,404 | B1 | 11/2001 | Tsai | |
| 6,996,864 | B2 * | 2/2006 | Call | 5/653 |
| 7,571,504 | B2 * | 8/2009 | Kuo | 5/724 |

FOREIGN PATENT DOCUMENTS

| | | |
|---|---|---|
| WO | WO 98/06303 | 2/1998 |
| WO | WO 00/03625 | 1/2000 |

* cited by examiner

CUSHIONING SYSTEM

This application is a National Stage Application of PCT/NZ2013/000158, filed 4 Sep. 2013, which claims benefit of Serial No. 602234, filed 4 Sep. 2012 in New Zealand and which applications are incorporated herein by reference. To the extent appropriate, a claim of priority is made to each of the above disclosed applications.

FIELD OF INVENTION

This invention relates to a cushioning system, which may be used with a wheelchair seat base or backrest, a mattress, a chair, a car seat, an aircraft seat, or any other seat or article in which cushioning is required.

BACKGROUND

Wheelchair users may be required to be seated in a wheelchair for extended periods. It is important that the wheelchair provides sufficient padding for comfort and to assist in preventing injuries associated with being seated for long periods. It is also helpful if wheelchair seating can be customised to meet the requirements of individual wheelchair users, especially high needs users of wheelchairs who may also require contoured seating to assist with their positioning in a wheelchair. For example, asymmetric seating may be necessary to encourage some users to sit as upright as possible.

It is known to provide contoured seats for wheelchairs. However, such seats are typically manufactured on a case by case basis, meaning that each seat is made for the individual needs of its user. The resulting seat is labour intensive and is typically expensive as a result. Another drawback of bespoke manufacturing of wheelchair seats is that the user's needs can change over time as a result of growth (especially in the case of a child) or as a result of a change in posture. This means, that the user then requires another wheelchair seat to be made especially for their needs and must wait while the seat is being manufactured.

Known wheelchair seats allow cells to be detachably attached to a base, but the cells are not able to be freely located anywhere on the base and oriented in any position relative to the base. Instead, the cells are fitted within pockets attached to the base, the cells being shaped to fit within the pockets in a certain orientation. Alternatively, the base comprises attachment means, such as strips of a hook and loop fastener such as VELCRO™, in only some areas of the base so that the cells can only be attached to the base in these areas and the cells are shaped so that they can only be oriented in a certain position relative to the base.

PCT patent publication no EP 08/06303 discloses one form of cushioning system having a contoured surface to be used with the seat base of a wheelchair. In this system, a plurality of inserts are attached to the base of a wheelchair seat in a certain configuration. The inserts are typically wedge shaped and are designed to locate the user's legs in a predetermined position. A flexible foam cushion is positioned above the inserts, the cushion having an upper surface that is contoured by the shape of the inserts. However, the inserts are positioned on the seat base in a certain position and in a certain orientation. In addition, the inserts cannot be attached to each other or stacked upon each other. Furthermore, the cushioning system is suitable only for the seat base of a wheelchair. The system is not able to be used also as a cushioning system for a backrest or mattress.

It is an object of a preferred embodiment of the present invention to go at least some way towards addressing the above needs or to at least provide a useful alternative to known cushioning systems.

The term "comprising" and derivatives thereof, such as "comprise" and "comprises", if and when used herein in relation to a combination of features should not be taken as excluding the possibility that the combination may have further unspecified features. For example, a statement that an arrangement "comprises" certain parts does not mean that it cannot also, optionally, have additional parts. In other words, the terms "comprises", "comprising", and similar words, are not to be interpreted in an exclusive or exhaustive sense. Instead, they are intended to mean "including, but not limited to.

Any reference to prior art documents in this specification is not to be considered an admission that such prior art is widely known or forms part of the common general knowledge in the field.

SUMMARY OF INVENTION

In one form, the invention provides a cushioning system having an adjustable contoured surface. The system comprises a panel; a plurality of cells; and attachment means for detachably attaching one or more cells to the panel at any location on the panel and in any orientation relative to the panel to provide the contoured surface. The contoured surface is determined by the number, shape, size, position, and orientation of cells on the panel.

Optionally, the panel is a flexible, sheet-like panel. Preferably, one or more cells are adapted to detachably attach to one or more other cells. More preferably, the cells are stackable upon one another. In a preferred form, the panel and cells each comprise a first attachment surface having attachment means to attach the cells to the panel. One or more cells may further comprise a second attachment surface that substantially opposes the first attachment surface, the second attachment surface having attachment means adapted to engage with attachment means located on the first attachment surface of another cell to attach two or more cells together.

In one form, one or more cells each comprise a pair of flexible tabs extending from the cell, the tabs providing the first attachment surface comprising the attachment means for attaching the cell to the panel. In this form, the panel comprises a positioning surface on which cells can be positioned, the first attachment surface of the panel substantially opposing the positioning surface. The panel further comprises a plurality of apertures through which the tabs can pass so that the attachment means of the tabs engages with the attachment means of the panel to attach cells to the panel. The apertures may be in the form of slots. Preferably, the slots are located at different positions on the panel and at different orientations relative to the panel. Optionally, the slots are curved or angular.

In a preferred form, the attachment means is a hook and loop fastening system. Preferably, substantially the whole of the attachment surface of the panel is covered with attachment means.

Preferably, the attachment means is a hook and loop fastening system and the attachment means covers substantially the whole of the first and/or second attachment surfaces of one or more cells.

Optionally, the cushioning system is enclosed within a cover.

In one form, the panel forms part of a cover for a cushioned support in the form of a seat base, backrest, or mattress.

Preferably, the panel forms a rear surface of the cover for the cushioned support and the cells are positioned between the panel and a front surface of the cover for the cushioned support. More preferably, a cushioning material is positioned between the cells and the front surface of the cover for the cushioned support. Preferably, the cushioned support is a backrest. In one form, the system is detachably attachable to a cushioned support in the form of a seat base, back rest, or mattress. Preferably, the panel comprises flaps having attachment means for attaching to the cushioned support. Preferably, the cells contain air and/or foam.

Preferably, the cushioning system includes cells of different sizes and shapes. In one form, the invention provides a seat comprising a cushioning system according to the invention. Alternatively, the invention provides a wheelchair comprising a cushioning system according to the invention. In yet another form, the invention provides a mattress comprising a cushioning system according to the invention. According to another aspect of the invention there is provided a cushioning system comprising: a flexible sheet support; a plurality of padding cells; and attachment means, associated in part with the sheet support and in part with the padding cells; the system formed such that the cells are detachably engageable with the sheet support by way of the attachment means, and the number and size of cells is sufficient to enable a user to adjustably assemble cells with respect to the support sheet to provide contoured padding for at least part of the human body.

Preferably the sheet support and the padding cells provide a detachable cushion. Preferably the parts of the attachment means associated with each cell are on two opposite sides of the cell.

Preferably the cells have flexible tabs to facilitate attachment to the sheet support. Preferably the sheet support has a series of slots through which the tabs of the cells can pass.

Preferably the cells are of differing size to facilitate the adjustable contoured padding. Preferably the cells are detachably stackable upon one another to facilitate the adjustable contoured padding.

Preferably the attachment means comprises a hook and loop fastener system. Preferably the cells contain air and/or foam.

Preferably the sheet support and the padding cells are enclosed within a fabric cover. Preferably the sheet support and the padding cells are engageable with a cushion.

Preferably the sheet support has flaps for attaching to the cushion. According to a further aspect of the invention there is provided a seat comprising a cushion system described above.

According to a further aspect of the invention there is provided a wheelchair comprising a cushion system described above.

According to a further aspect of the invention there is provided a mattress comprising a cushion system described above.

In another form, the cushioning system may be used with a wheelchair, where a plurality of cells form part of a cushion or are mounted to a seat base and/or backrest to provide cushioning.

BRIEF DESCRIPTION OF THE DRAWINGS

Preferred forms of the invention will now be described by way of example and with reference to the accompanying drawings, in which.

DETAILED DESCRIPTION

Figure 1:
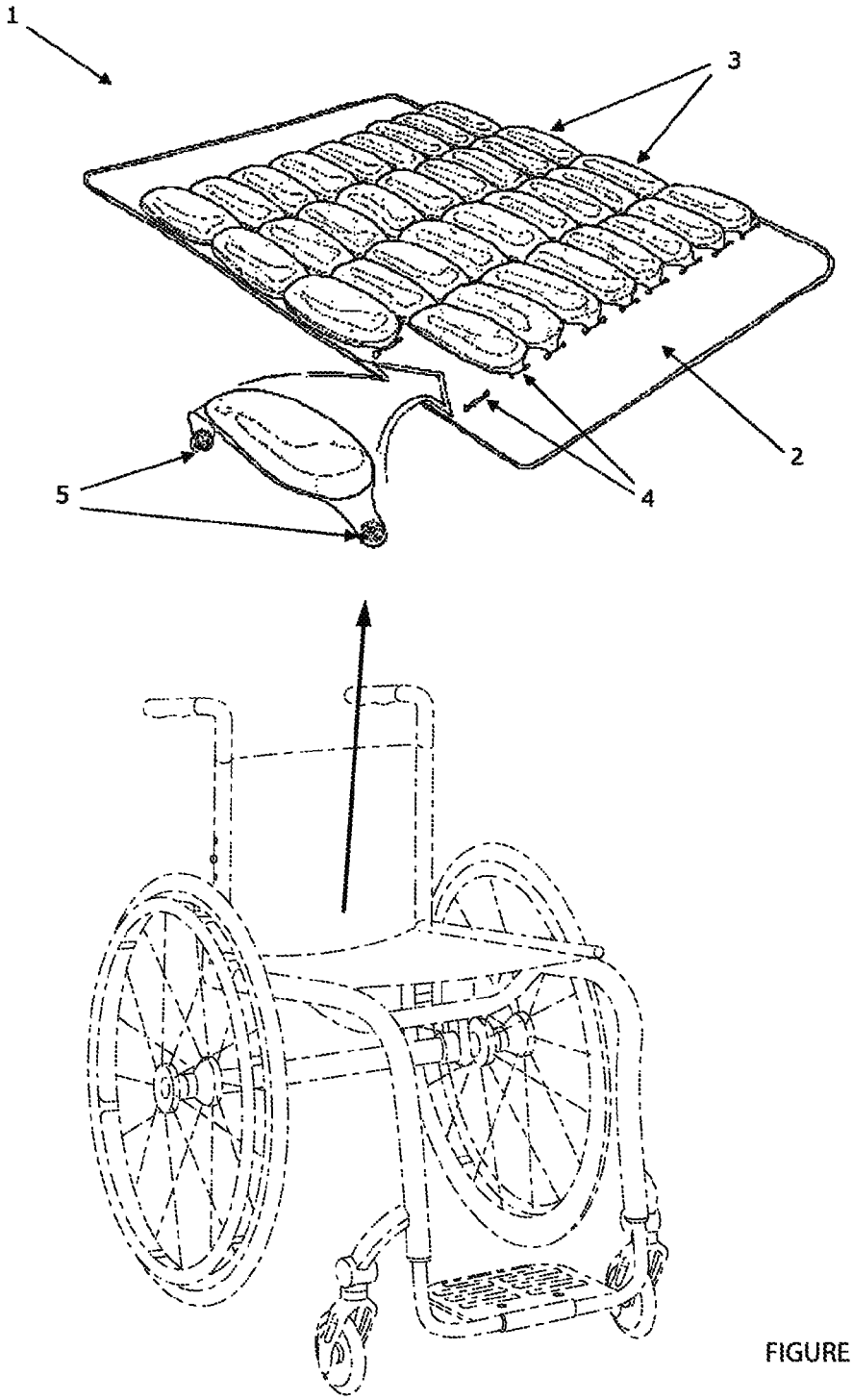
FIG. 1 is a perspective view of one form of cushioning system from above.

The invention is further described with reference to the following examples. It will be appreciated that the invention as claimed is not intended to be limited in any way by these examples. Referring to FIG. 1, there is provided a first cushioning system 1 having a contoured surface that is adjustable to meet the needs of the user. The cushioning system comprises a panel 2 and a plurality of cells 3 that are detachably attachable to the panel to provide a contoured surface. When the desired number and configuration of cells 3 has been attached to the panel 2, the panel 2 is positioned beneath a cushioned support (or is positioned behind a cushioned support in the case of a backrest) to provide contouring to the cushioned support. Where the cells are cushioned cells, the panel can optionally be positioned on top of (or in front of) a cushioned support. Alternatively, the cushioning system comprising the panel and cells can be used as an independent cushioned support.

The cushioned support may be any cushioned object for which a contoured surface is required. For example, the cushioned support may be a cushioned seat base, backrest, mattress, or the like. Preferably, the cushioned support is a cushioned seat base or backrest for a wheelchair.

The panel is typically a sheet-like flexible fabric panel. However, in some embodiments where the panel is to be attached behind or below a cushioned support, such as a seat base, backrest, or mattress, the panel may optionally be semi-rigid or rigid.

FIGS. 1 to 4 show one form of cushioned cell in which each cell 3 comprises a cover encompassing a cushioning material. In one form, the cover is made of flexible material, such as urethane welded around cushioning material in the form of a piece of cushioning foam. The foam includes air within the cell 3 so that if the cell 3 were to burst and release the air, the cell retains at least some degree of cushioning by way of the foam. In another form, air envelops the foam and is trapped within the cover to provide additional cushioning.

It will be appreciated that it is not essential for the cell to include a cover. For example, in one form, the cells may simply comprise foam pads or plastic pads.

Figure 3B:
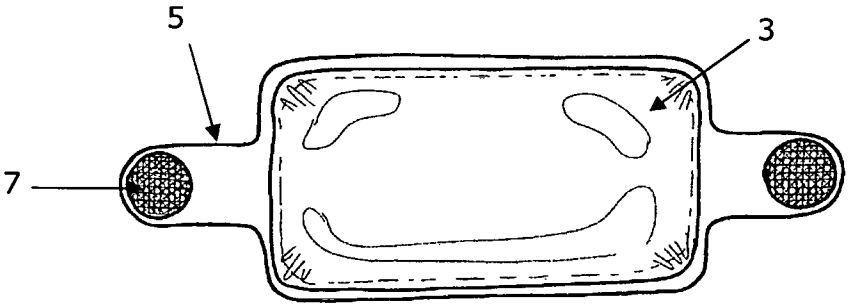
FIG. 3*b* is a bottom view of the cushioning cell of FIG. 3*a;*
Figure 3C:
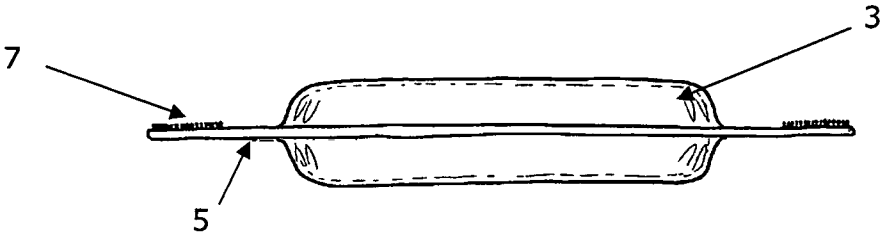
FIG. 3*c* is a side view of the cushioning cell of FIG. 3*a;*
Figure 3A:
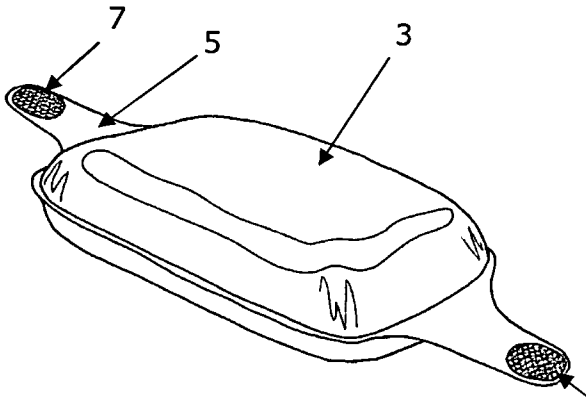
FIG. 3*a* is a perspective view from below of a cushioning cell.

In the embodiment shown in FIGS. 3*a* to 3*c*, each cell comprises a pair of flexible tabs that extend from opposing ends of the cell. In a preferred form, each flexible tab is integral with the cell. In yet another form, each tab is attached to the cell.

Each tab 5 comprises a first attachment surface having attachment means to attach each cell to the panel.

The panel has a positioning surface or topside on which the cells can be positioned, and also has a substantially opposing attachment surface or underside to which the cells can be attached. The panel comprises a plurality of apertures through which tabs of the cells can pass. The attachment means of the tabs engage with attachment means located on the attachment surface of the panel to detachably attach the cells to the panel.

Figure 2:
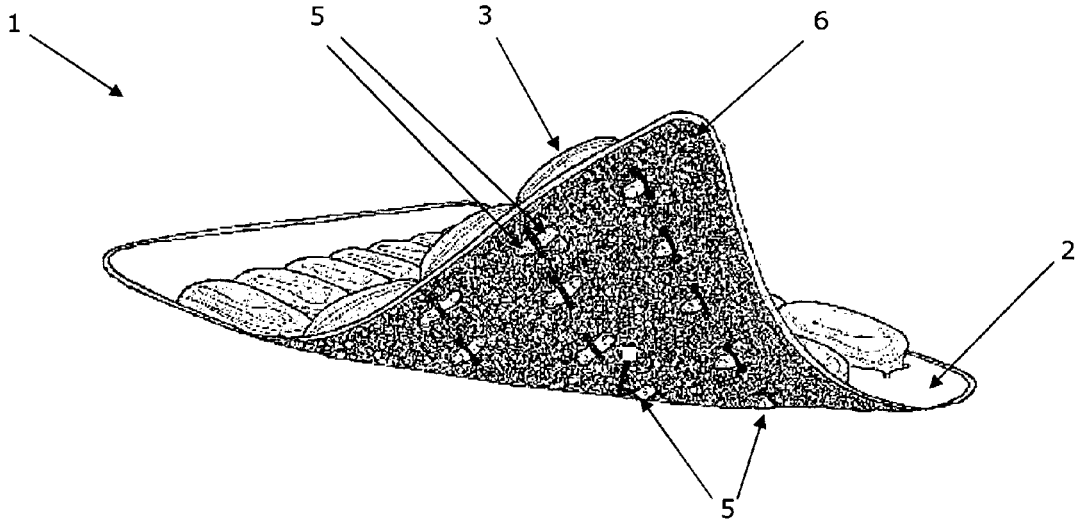
FIG. 2 is a perspective view of the cushioning system of FIG. 1 from below.

In the embodiment shown in FIG. 2, the panel 2 comprises a flexible sheet-like fabric having a plurality of apertures in the form of slots 4 through which the tabs 5 at each end of each cell 3 can pass. The panel underside 6 comprises attachment means that engage with the attachment means located on the tabs to detachably attach the tabs of the cells to the underside of the panel. In one form, the panel may comprise a plurality of apertures in the form of slots placed at different locations on the panel and at different orientations relative to the panel. In another form, one or more apertures are in the form of a slot that extends across almost the entire width or length of the panel so that tabs of cells can be slid along the slot and attached to the panel at any position along the length of the slot. In another form, one or more apertures are in the form of substantially curved or angular slots so that the position of the cells can be oriented relative to the panel and the tabs of cells can pass through the relevant slots to attach the cells to the panel. In yet another form, one or more apertures may be triangular in shape to allow the cells to be attached to the panel and positioned at different orientations to the panel. Thus, in these embodiments, it is possible to attach the cells to the panel in many different locations on the panel and to position the cells in many different orientations relative to the panel.

In one form, as shown in FIGS. 3*a* to 3*c*, each tab comprises attachment means in the form of a hook or loop fabric that engages with the attachment means in the form of a cooperating loop or hook fabric located on the underside of the flexible panel 2 to attach the cells 3 to the panel 2. Preferably, the hook and loop fabrics are VELCRO™.

For example, the embodiment shown in FIGS. 3*a*, 3*b* and 3*c*, comprises circular dots 7 proximate the end of each tab 5. The dots 7 have hook fabric of a hook and loop system, for example VELCRO™, on one side of each dot 7. To attach the cells 3 to the panel 2, the tabs 5 are passed through the apertures in the form of slots 4 and are folded toward the panel underside 6 so that the hook fabric of each dot 7 engages with the loop fabric of the panel underside 6 to hold each air cell 3 in place on the panel 2.

In another form, the attachment means used to attach tabs of the cells to the underside of the panel may comprise domes, a hook and eye system, a tacky or sticky surface such as that provided by a low-strength adhesive, or any other suitable materials to detachably attach the tabs to the underside of the panel.

In one form, the tabs are deliberately long and flexible and substantially the whole of the attachment surface of the panel is covered in attachment means (such as a hook and loop fastener such as VELCRO™ or low-strength adhesive), so that the cells can be positioned at various orientations relative to the panel and the tabs can be passed through the desired apertures and attached to the attachment surface of the panel at any location on the panel. By providing long tabs, it is also possible to stack cells on top of each other, the tabs on the upper cells needing to be longer than those on the lower cells so that the upper cell(s) tabs can reach over the lower cell(s) and through the apertures to attach the upper cell(s) to the panel. Preferably, the body of each cell includes a first attachment surface facing toward the panel and a substantially opposing second attachment surface facing away from the panel. The first and second attachment surfaces each comprise attachment means adapted so that the attachment means on the first surface of one cell can engage with attachment means on the second surface of another cell to attach the cells together in a stacked arrangement. By attaching cells to each other in this way, stacked cells are less likely to move relative to each other. The attachment means may be any suitable means by which the cells can be detachably attached to each other. For example, the attachment means may be a hook and loop system, such as VELCRO™, a low-strength adhesive, domes, hook and eye fasteners, or the like. The attachment means may cover substantially the whole of the first and second surfaces so that the cells can be stacked in a tower-like arrangement, where one cell is directly above another, or so that the cells can be stacked in an overlapping arrangement in which an upper cell is in an offset position relative to a lower cell to which it is attached. Because the cells can be detachably attached to the panel in any desired configuration allowed by the apertures or slots 4, the cells 3 can be arranged on the panel 2 in a customised way. For example, cells can be attached toward either the left or the right of the first surface of the panel 2 to provide asymmetric contouring. Furthermore, the cells 3 can be individually replaced if one is damaged by detaching a cell from other cells (if necessary) and from the panel and then attaching a replacement cell.

Figure 4:
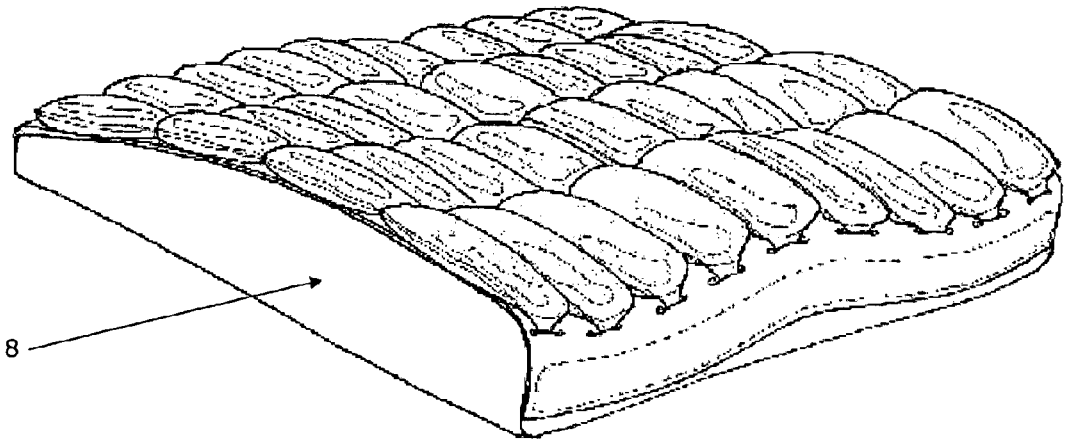
FIG. 4 is a perspective view of one form of contoured cushioning system attached to a cushioned support.

Optionally, the panel with attached cells is attached to a cushion base 3, as shown in FIG. 4. The cushioning system may therefore comprise attachment means for attaching to a cushioned support. In one form, the cushion base 8 comprises hook or loop attachment means and the panel comprises cooperating loop or hook attachment means to attach the cushioning system to the cushion base. Preferably, the attachment means comprises a hook and loop fastener such as VELCRO™ Preferably, the top of the cushion base is covered with a hook fastener such as VELCRO™ to attach to a loop fastener such as VELCRO™ located on the underside of the panel. In this form, the panel 2 is secured to the cushion base 8 by placing the panel 2 on the cushion base 8 so that the loop fabric of the panel 2 engages with the hook fabric of the cushion base 8.

Figure 5B:
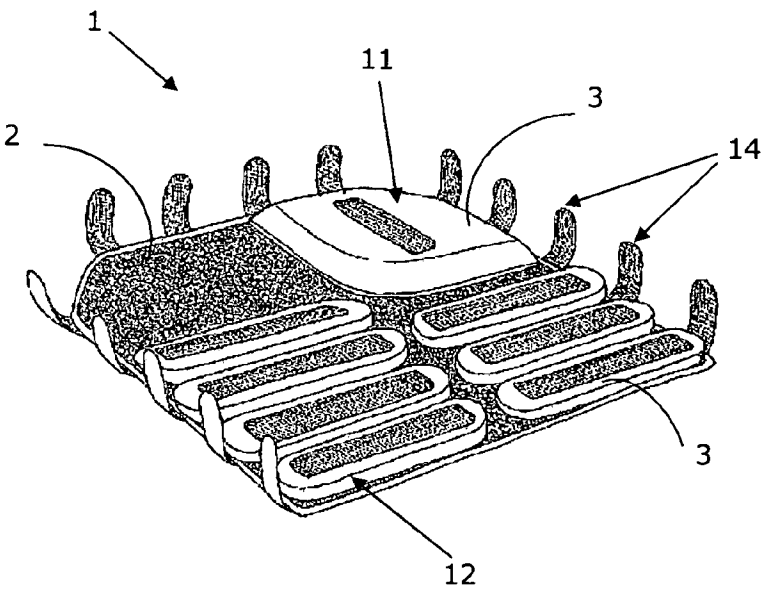
FIG. 5*b* is a perspective view of the cushioning system of FIG. 5*a* in which the cells are attached to the base.
Figure 5A:
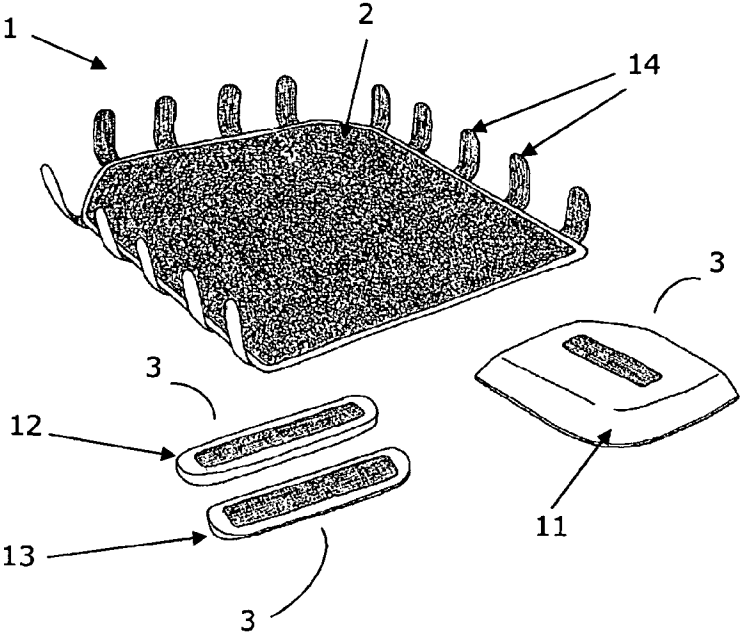
FIG. 5*a* is a perspective view of another form of contoured cushioning system showing a base and cells separately.

The cushioning system may be placed inside a cover and used on its own as an independent cushioned support or it may be attached to a cushioned support such as a cushion base. Similarly, the cushion base 8 with attached panel 2 and cells 3 can be used on its own as an independent cushioned support or the combined system may be placed inside a cover and used as a cushioned support. With or without a cover, the cushioning system of the invention may be used behind or in front of a cushioned support, such as a mattress, seat cushion, seat backrest, wheelchair seat cushion or backrest, or the cushioning system may be used as an independent cushioned support. FIGS. 5*a* and 5*b* show a second form of cushioning system 1 having a contoured surface that is adjustable to meet the needs of the user. As above, the cushioning system comprises a panel 2 to which a plurality of cells 3 are attached. The panel and cells are adapted so that the cells can be detachably attached to the panel at any location on the panel and in any orientation. The second cushioning system is used in addition to or as an alternative to the first cushioning system shown in FIGS. 1 to 4. Again, the flexible panel and cells are typically positioned behind or beneath a cushioned support, such as a cushioned seat, backrest, or a mattress, to provide a contoured cushioning system. Alternatively, or additionally, the flexible panel and cells can be used as an independent cushioned support.

The panel comprises an attachment surface to which the cells can be attached. For example, each cell comprises a first attachment surface having means adapted to engage with attachment means located on the attachment surface of the panel to attach the cells to the panel 2. The attachment means may be any suitable attachment means that engage with each other to detachably attach the cells to the panel.

For example, the attachment means may comprise a hook and loop system (such as VELCRO™), domes, a hook and eye system, a tacky or sticky surface such as that provided by a low-strength adhesive, or any other suitable materials to detachably attach the cells to the panel.

In one form, the panel comprises a flexible sheet-like fabric 10 having an attachment surface comprising a hook or loop fastener such as VELCRO™. The cells are in the form of a pelvic pad 11 and a number of thigh pads 12 and thigh wedges 13, each having a first surface and an opposing second surface. The first surface of the cells forms an attachment surface comprising loop or hook VELCRO™ for engaging with the respective hook or loop VELCRO™ of the panel to enable the cells to be attached to the panel 2. The hook and loop fastener such as VELCRO™ may be in the form of strips, dots, or the hook and loop fastener such as VELCRO™ may substantially cover the whole of the panel and the first attachment surface of each cell.

In a preferred form, the attachment surface of the panel is covered in either a loop fastener such as VELCRO™ or in a textured fabric to which a hook fastener such as VELCRO™, applied to the cells, can attach, in one form, the cells are adapted to be stackable. In this form, the body of each cell comprises first and second surfaces forming first and second attachment surfaces respectively. Each attachment surface comprises attachment means adapted to attach the respective cell to another cell. Thus, the attachment means on the first surface of each cell is adapted to engage with attachment means on the second surface of another cell and/or with the attachment surface of the panel.

For example, as shown in FIGS. 5*a*, 5*b*, 6*a*, and 6, the cells in the form of pelvic pads 11, thigh pads 12 and thigh wedges 13 each have a strip of a hook fastener such as VELCRO™ on their first attachment surface and a strip of a loop fastener such as VELCRO™ on their second attachment surfaces, enabling the pads and wedges to be attached to each other and stacked as desired. Where the cells are stacked on top of each other, it is possible to increase the effective height of the contouring system to achieve a contoured surface suitable for the needs of an individual user.

In yet another form, not shown, the cells comprise attachment means on all sides of the cells so that the cells can be attached to each other vertically and/or horizontally. The shape, height and compressibility of each cells is selected based on the needs of the user. For example, a cell in the form of a pelvic pad 11 is designed to change the angle of the pelvis of a person sitting on the pad system 9 when it is used as a seat base and is placed on either the right or left of the seat base 10. A cell in the form of a thigh pad 12 is preferably rectangular in shape and a cell in the form of a thigh wedge 13 has at least one tapered side. The thigh pad 12 and thigh wedge 13 may be lower in height than the pelvic pad 11 to reduce the severity of the angle between the pelvic pad 11 and the base 10.

When used in addition to the first cushioning system described above and shown in FIG. 1, to provide extra customised padding or contouring, the second cushioning system is positioned behind or beneath the first cushioning system and is attached to the first cushioning system. In one form the second cushioning system has a plurality of flaps 14 having attachment means adapted to engage with corresponding attachment means located on the first cushioning system or on a cushion base to which the first contoured cushioning system is attached. For example, as shown in FIGS. 5*a* and 5*b*, the flaps 14 comprise loop or hook fasteners such as VELCRO™ to attach to corresponding hook or loop fasteners such as VELCRO™ (not shown) on the first cushioning system or cushion base 8.

A cover may be used to encompass the first and second cushioning systems or to encompass the second cushioning system alone.

Figure 6B:
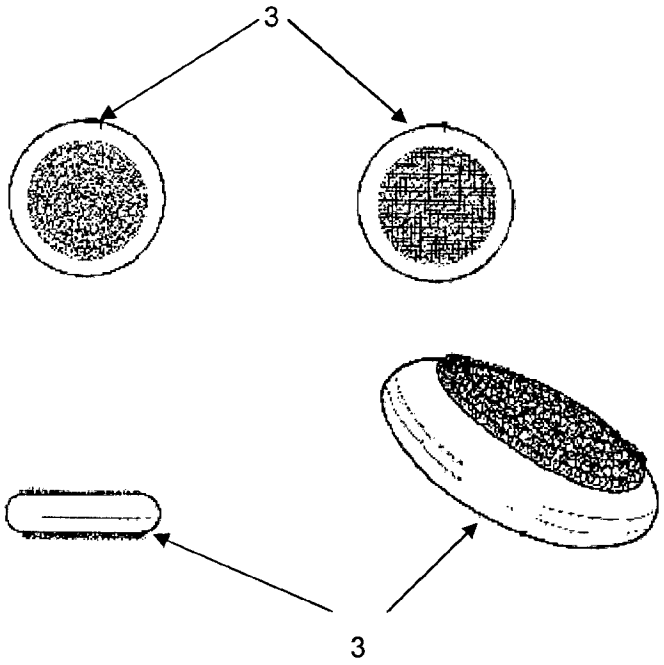
FIG. 6*b* shows top, bottom, side, and perspective views of a cushioning cell in the form of a disk.
Figure 6A:
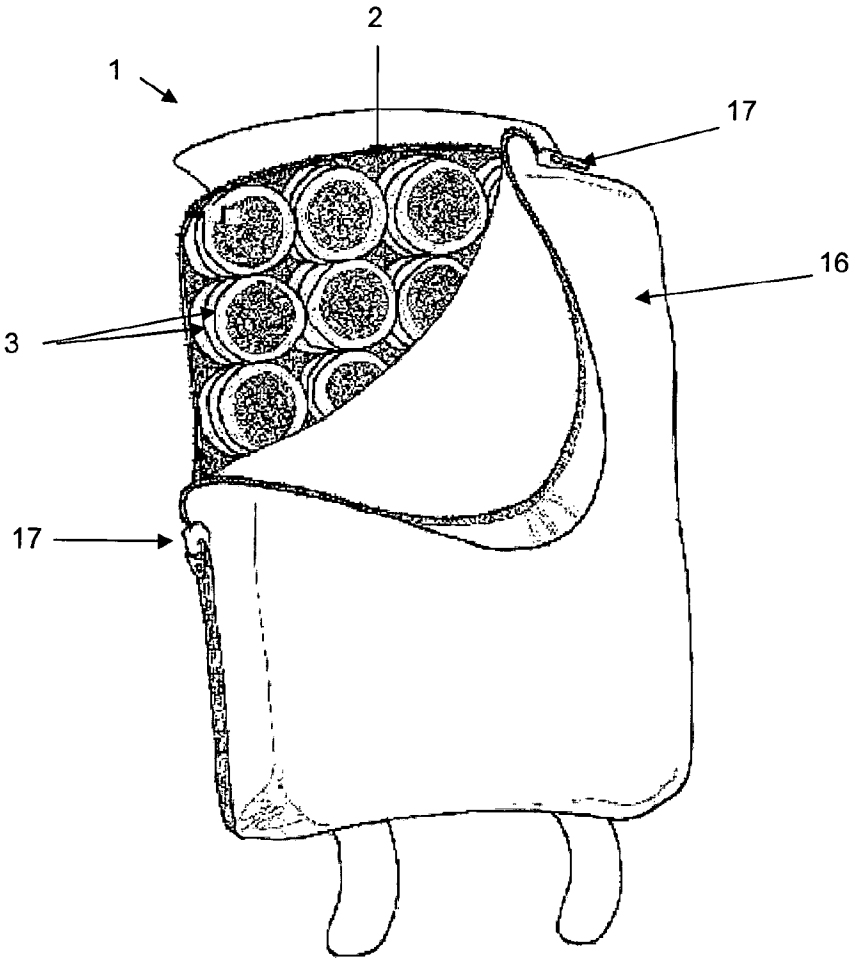
FIG. 6*a* is a perspective view of yet another form of cushioning system using cells in the form of disks.

FIGS. 6*a* and 6*b* show a further alternative embodiment of the invention, in which the cushioning system is integrated within a cover. In this form, the panel 2 of the cushioning system forms part of a cover 16 for substantially encompassing the cushioning system. In one form, the panel comprises a sheet-like flexible panel that is made of fabric. The panel forms either the front or rear side of the cover and includes an attachment surface comprising attachment means for engaging with attachment means provided on the cells to detachably attach cells to the panel. The cells can be positioned at any location on the panel and at any orientation relative to the panel.

In one form, as shown in FIGS. 6*a* and 6*b*, the rear of the cover 16 forms the panel 2. The inside surface of the rear of the cover forms an attachment surface and comprises attachment means, preferably in the form of a hook and loop fastener such as VELCRO™. Preferably, substantially the whole of the first surface is covered with or formed from a hook and loop fastener such as VELCRO™, especially a loop fastener such as VELCRO™ or a textured material (such as fleece) with which a hook fastener such as VELCRO™ can engage. Each cell 3 also comprises corresponding attachment means, preferably in the form of a hook and loop fastener such as VELCRO™, especially a hook fastener such as VELCRO™, located on the first attachment surface of the cell to engage with the attachment means of the panel. In this way, the cells can be detachably attached to the panel.

As described above, each cell may include first and second substantially opposing attachment surfaces, each surface having attachment means so that the cells can be attached to each other and stacked upon each other to provide an additional level of contouring. The cells may be stacked in a tower arrangement, as shown in FIG. 6*a*, or the cells may be stacked so as to overlap each other to provide graduated contouring. Preferably, the attachment means covers substantially the whole of the first and second attachment surfaces of the cells to allow the cells to easily attach to each other in an overlapping arrangement.

Returning to FIGS. 6*a* and 6*b*, the front of the cover is adapted to cover the cells and attach to the rear of the cover by any suitable means, such as with a zip, a hook and loop fastener such as a VELCRO™ fastener, domes, or the like, so that the interior of the cover can be easily accessed. This arrangement allows the cells to be removed or repositioned as desired according to the needs of the user.

FIGS. 6*a* and 6*b* show a cushioning system 1 comprising a cover 16 with a zip opening 17 to allow access to the interior of the cover. The cover 16 is made from spandex/Lycra™ or other suitable fabric. The inside rear surface of the cover 16 is formed of a loop fastener such as VELCRO™ fabric and acts as a panel 2 to which cells 3 can be detachably attached. The cells are provided in the form of round foam disks 3 having substantially opposing first and second surfaces. The first surface of the foam disks forms a first attachment surface comprising a hook fastener such as VELCRO™ fabric. When in use, the disks 3 are placed on the rear surface 2 of the cover 16. The hook fabric of each disk 3 engages with the loop fabric of the rear surface 2 of the cover 16 to hold each disk 3 in place.

Optionally, the second surface of the foam disks forms a second attachment surface comprising a loop fastener such as VELCRO™. Because the disks 3 have a hook and loop fastener such as VELCRO™ on each side, they can be attached to the rear surface 2 of the cover 16 and can also be attached to each other and stacked on top of each other. The disks 3 can thus be arranged in a customised way and rearranged as necessary. The disks 3 are approximately 50 mm in diameter and approximately 10 mm in width but may be made in greater or smaller sizes as desired.

Figure 7B:
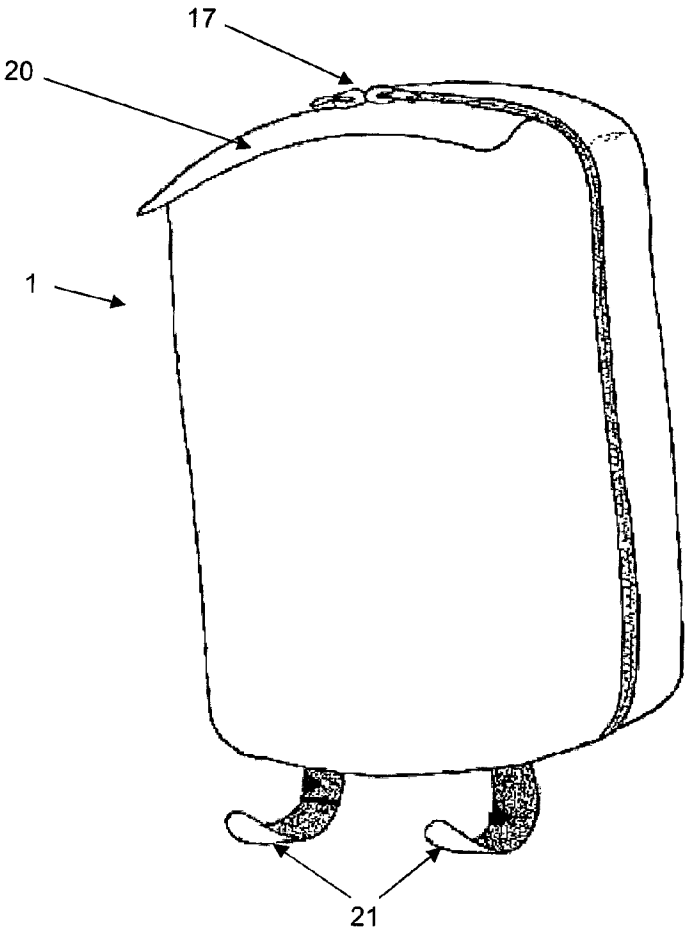
FIG. 7*b* is a rear perspective view of the rear of the contoured cushioning system of FIG. 6*a* in which the cells are encased in a cover.
Figure 7A:
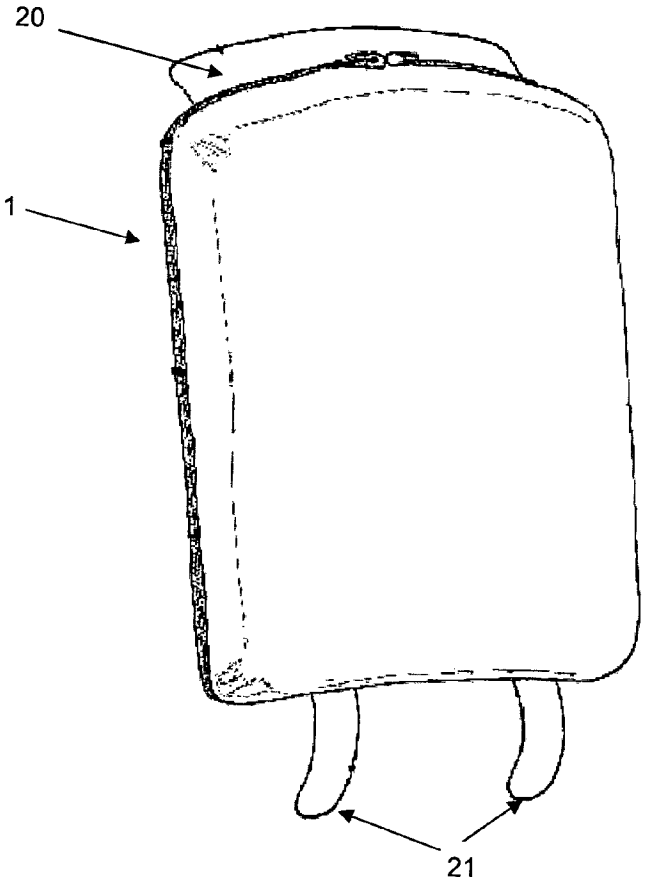
FIG. 7*a* is a front perspective view of the contoured cushioning system of FIG. 6*a* in which the cells are encased in a cover.

Referring to FIGS. 7*a* and 7*b*, the cushioning system 1 in which the panel is integrated with the cover of the cushioning system may be used in any form of cushioned support, such as a seat base, backrest, or mattress. In the embodiment shown in FIGS. 7*a* and 7*b*, the cushioning system is used in a backrest for a seat, especially a wheelchair, and may include attachment means to attach the cushioning system to the seat back. In one form, the cover comprises an upper flap 20 and lower flaps 21 having a loop or hook fastener such as VELCRO™ to attach to corresponding hook or loop fastener such as VELCRO™ located on a backrest structure (not shown).

Figure 8:
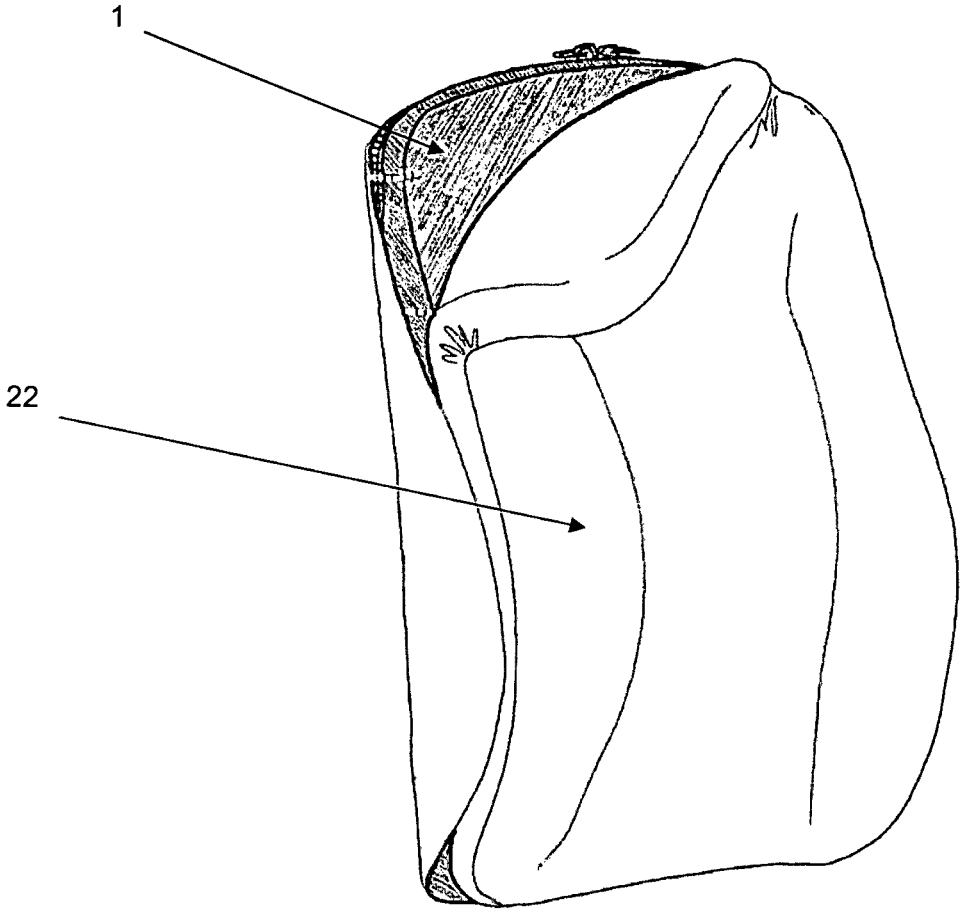
FIG. 8 is a perspective view of the contoured cushioning system of FIG. 6*a* when located behind a backrest cushion.

In one form, as shown in FIG. 8, the cushioning system 1 may be used in a backrest and may be positioned within an exterior cover 22 that is adapted to cover both the cushioning system and a cushioned support for the backrest. The exterior cover 22 is designed to open to allow the cushioning system 1 to be placed inside it. The exterior cover 22 may include attachment means (such as a hook and loop fastener such as VELCRO™, domes, or the like) on its interior to engage with corresponding attachment means located on the cushioning system 1. For example, the cushioning system may comprise an upper flap 20 and a lower flap 21 having attachment means for engaging with corresponding attachment means of the exterior cover to attach the cushioning system to the exterior cover and hold the cushioning system in position relative to the cover. In any embodiment according to the invention, the cells can be of any suitable shape, including oblong shapes, such ovals or rectangles. The cells could also be hexagonal, round disks, star shaped, wedge shaped, or elongate semi-cylindrical shapes for use as a lumbar support example. The cushioning system optionally includes different shaped cells, the cells being shaped to have specific uses, such as being wedge shaped to encourage a user to position a part of their body in a predetermined direction. Alternatively, the cushioning system may comprise cells of a consistent shape. The cells can also be of any size and can be located at any position on the panel and at any orientation relative to the panel to customize the cushioning system to meet the needs of individual users. Cells can also be stacked on top of each other to provide added height. For example, some areas of the panel may be without cells, some areas of the panel may include cells of various sizes and heights, and some areas may include cells stacked on top of each other.

The cells may be of any suitable form in which the cells are able to withstand compression pressures to provide contouring for prolonged periods. For example, the cells may be firm, hard, or cushioned cells.

Firm cells may be made from firm foam, plastic, or the like, or the cells may be substantially inflated air cells, or any combination of materials that form firm cells, the cells having some degree of compressibility under normal operating pressures. Hard cells may be made from hardened plastic, resin, metal, composite materials, tightly inflated air cells, or the like, that have little or no degree of compressibility under normal operating pressures. Cushioned cells may be made from any suitable cushioning material, such as foam, gel, semi-inflated air cells, padded cells, or the like, or any combination of two or more cushioning materials, and are substantially compressible under normal operating pressures. Thus, air cells can be cushioned cells, firm cells, or hard cells depending on the extent to which the cell is inflated with air.

The cells can be attached to the panel to provide contouring by removing cells from predetermined areas of the panel and/or by varying the thickness of one or more cells and/or by stacking one or more cells on top of each other (either in a tower arrangement or in an overlapping arrangement).

Thus, the number, size, shape, position, and orientation of the cells can be used to modify the surface contour of the cushioning system and to modify the surface contour of a cushioned support placed in front of or on top of the cushioning system. For example, as a person applies pressure to a cushioned support comprising the cushioning system of the invention (such as by sitting on the cushioned support, leaning on it, or lying on it, as the case may be), the surface of the cushioned support moulds around the contoured surface provided by the cells of the cushioning system.

The cushioning system of the invention may be detachably attachable to a cushioned support in the form of a seat base, back rest, or mattress. The cushioning systems described above assist in providing comfort to a user, in particular to a wheelchair user, and assist in relieving pressure on the body of a user required to sit for long periods of time. While the cushioning systems described above are suitable for wheelchairs, they can also be used for other types of seating and for mattresses.

ADVANCES OF THE INVENTION

The present invention can be used to provide customized contoured cushioning to meet the needs of individual users. Because the cells can be easily attached and detached from the panel, the contouring provided by the system can be easily and quickly changed as the needs of the user change. The cells can be positioned at any desired location on the panel so that the contouring system is not restricted by pockets or attachment means designed to attach cells in fixed locations only. Furthermore, the cells can be positioned in any orientation relative to the panel. The cells can also be stacked on top of each other in a tower arrangement or in an overlapping arrangement to provide another level of contouring.

The cells can be of any suitable size, shape, and degree of compressibility. Damaged cells or cells of an unsuitable size or shape can be easily removed and replaced if necessary.

Thus, the system allows for fast, unrestricted freeform positioning and rearranging of cells on the panel to provide fully customized contouring of a cushioned seat base or backrest to suit the user's individual needs.

Although the invention has been described by way of example, it should be appreciated that variations and modifications may be made without departing from the scope of the invention as defined in the claims. Furthermore, where known equivalents exist to specific features, such equivalents are incorporated as if specifically referred in this specification.

We claim:

1. A cushioning system having an adjustable contoured surface, the system comprising:

a) a panel;

b) a plurality of cells; and c) attachment means for detachably attaching one or more cells to the panel at any location on the panel and in a plurality of orientations relative to the panel to provide a contoured surface, wherein the contoured surface is determined by the number, shape, size, position, and orientation of cells on the panel, wherein one or more cells are adapted to detachably attach to one or more other cells.

2. A cushioning system according to claim 1, wherein the panel is a flexible, sheet-like panel.

3. A cushioning system according to claim 1, wherein the cells are stackable upon one another.

4. A cushioning system according claim 1, wherein the panel and cells each comprise a first attachment surface having attachment means to attach the cells to the panel.

5. A cushioning system according to claim 4, wherein substantially the whole of the attachment surface of the panel is covered with attachment means.

6. A cushioning system according to claim 4, wherein one or more cells further comprise a second attachment surface that substantially opposes the first attachment surface, the second attachment surface having attachment means adapted to engage with attachment means located on the first attachment surface of another cell to attach two or more cells together.

7. A cushioning system according to claim 6, wherein the attachment means is a hook and loop fastening system and wherein the attachment means covers substantially the whole of the first and/or second attachment surfaces of one or more cells.

8. A cushioning system according to claim 1, wherein the attachment means is a hook and loop fastening system.

9. A cushioning system according to claim 1, wherein the cushioning system is enclosed within a cover.

10. A cushioning system according to claim 1, wherein the panel forms part of a cover for a cushioned support in the form of a seat base, backrest, or mattress.

11. A cushioning system according to claim 10, wherein the panel forms a rear surface of the cover for the cushioned support and the cells are positioned between the panel and a front surface of the cover for the cushioned support.

12. A cushioning system according to claim 11, wherein a cushioning material is positioned between the cells and the front surface of the cover for the cushioned support.

13. A cushioning system according to claim 11, wherein the cushioned support is a backrest for a chair or wheelchair.

14. A cushioning system according to claim 1, wherein the system is detachably attachable to a cushioned support in the form of a seat base, back rest, or mattress.

15. A cushioning system according to claim 1, wherein the cells include cells of different sizes and shapes.

16. A wheelchair comprising a cushioning system according to claim 1.

17. A cushioning system having an adjustable contoured surface, the system comprising:

a) a panel; and b) a plurality of cells disposed on a first side of the panel wherein each of the plurality of cells comprises attachment elements for detachably attaching one or more cells to the panel at any location on the panel and in a plurality of orientations relative to the panel to provide a contoured surface, wherein the contoured surface is determined by the number, shape, size, position, and orientation of cells on the panel, wherein at least one of the attachment element is configured to be secured to a second side of the panel.

18. A cushioning system according to claim 17, wherein the panel and cells each comprise a first attachment surface having attachment elements to attach the cells to the panel.

19. A cushioning system according to claim 18, wherein one or more cells each comprise a pair of flexible tabs extending from the cell, the tabs providing the first attachment surface comprising the attachment means for attaching the cell to the second side of the panel; wherein the first side comprises a positioning surface on which cells can be positioned, the first attachment surface of the panel disposed on the second side of the panel opposite the positioning surface; and wherein the panel further comprises a plurality of apertures through which the tabs can pass so that the attachment means of the tabs engages with the attachment means of the panel to attach cells to the panel.

20. A cushioning system according to claim 19, wherein the apertures are in the form of curved, angled or substantially straight slots.

21. A cushioning system according to claim 20, wherein the slots are located at different positions on the panel and at different orientations relative to the panel.

22. A cushioning system according to claim 17, wherein the attachment elements are at least one of hook and loop fasteners, domes, and adhesives.

* * * * *